US012116994B2

(12) United States Patent
Nettesheim

(10) Patent No.: US 12,116,994 B2
(45) Date of Patent: Oct. 15, 2024

(54) DIAPHRAGM PUMP

(71) Applicant: PSG GERMANY GMBH, Duisburg (DE)

(72) Inventor: Simon Nettesheim, Krefeld (DE)

(73) Assignee: PSG Germany GmbH, Duisburg (DE)

( * ) Notice: Subject to any disclaimer, the term of this patent is extended or adjusted under 35 U.S.C. 154(b) by 250 days.

(21) Appl. No.: 17/281,964

(22) PCT Filed: Oct. 9, 2019

(86) PCT No.: PCT/EP2019/077346
§ 371 (c)(1),
(2) Date: Apr. 9, 2021

(87) PCT Pub. No.: WO2020/074576
PCT Pub. Date: Apr. 16, 2020

(65) Prior Publication Data

US 2021/0355934 A1 Nov. 18, 2021

(30) Foreign Application Priority Data

Oct. 11, 2018 (DE) ..... 10 2018 008 036.7

(51) Int. Cl.
*F04B 53/10* (2006.01)
*F04B 43/02* (2006.01)

(52) U.S. Cl.
CPC ..... *F04B 53/1047* (2013.01); *F04B 43/02* (2013.01)

(58) Field of Classification Search
CPC .... F04B 43/02; F04B 43/025; F04B 53/1047; F04B 53/106; F04B 53/1052; F04B 53/1055; F16K 15/1401; Y10T 137/7838
USPC ..... 417/458, 563, 564, 571
See application file for complete search history.

(56) References Cited

U.S. PATENT DOCUMENTS

| | | | |
|---|---|---|---|
| D239,210 | S | 3/1976 | Marlow |
| 4,158,530 | A | 6/1979 | Bernstein |
| 4,238,992 | A | 12/1980 | Tuck, Jr. |
| 4,247,264 | A | 1/1981 | Wilden et al. |
| 4,270,441 | A | 6/1981 | Tuck, Jr. |

(Continued)

FOREIGN PATENT DOCUMENTS

| | | |
|---|---|---|
| DE | 19833286 A1 | 2/1999 |
| DE | 19736703 | 3/1999 |

(Continued)

OTHER PUBLICATIONS

International Search Report and Written Opinion as issued in connection with International Patent Application No. PCT EP2019/007346 mailed Jan. 28, 2020.

(Continued)

*Primary Examiner* — Philip E Stimpert
(74) *Attorney, Agent, or Firm* — Fish & Richardson P.C.

(57) ABSTRACT

A diaphragm pump with at least one pump chamber, the pump chamber being connected to an inlet chamber via an inlet valve and to an outlet chamber via two outlet valves. The inlet valve having an inlet opening that can be closed by an inlet valve body and the outlet valve respectively having an outlet opening that can be closed by an outlet valve body. The two outlet valves and the inlet valve form a triangle in a projection onto a projection plane transverse to the longitudinal axis of the pump chamber.

21 Claims, 5 Drawing Sheets

(56) References Cited

U.S. PATENT DOCUMENTS

| | | | | |
|---|---|---|---|---|
| D275,858 | S | 10/1984 | Wilden | |
| 4,549,467 | A | 10/1985 | Wilden et al. | |
| 4,570,833 | A * | 2/1986 | Vanderjagt | F04B 53/106 417/269 |
| D294,946 | S | 3/1988 | Wilden | |
| D294,947 | S | 3/1988 | Wilden | |
| 5,007,803 | A | 4/1991 | DiVito et al. | |
| 5,141,409 | A | 8/1992 | Hirosawa et al. | |
| 5,147,182 | A | 9/1992 | Timmons | |
| D331,412 | S | 12/1992 | Wilden | |
| 5,169,296 | A | 12/1992 | Wilden | |
| 5,378,122 | A | 1/1995 | Duncan | |
| 5,634,391 | A | 6/1997 | Eady | |
| D382,277 | S | 8/1997 | Feitel et al. | |
| 5,687,633 | A | 11/1997 | Eady | |
| 5,743,170 | A | 4/1998 | Pascual | |
| 5,957,670 | A | 9/1999 | Duncan | |
| 6,053,713 | A * | 4/2000 | Brown | F04B 39/064 417/571 |
| 6,102,363 | A | 8/2000 | Eberwein | |
| 6,230,609 | B1 | 5/2001 | Bender et al. | |
| 6,257,845 | B1 | 7/2001 | Jack et al. | |
| D448,778 | S | 10/2001 | Iwata | |
| 6,343,539 | B1 | 2/2002 | Du | |
| 6,357,723 | B2 | 3/2002 | Kennedy et al. | |
| 6,435,845 | B1 | 8/2002 | Kennedy et al. | |
| D498,766 | S | 11/2004 | Iwata | |
| D499,116 | S | 11/2004 | Iwata | |
| D512,441 | S | 12/2005 | Iwata | |
| 7,063,516 | B2 | 6/2006 | Bethel | |
| 7,125,229 | B2 | 10/2006 | Bistaso et al. | |
| 7,399,168 | B1 | 7/2008 | Eberwein | |
| 7,452,166 | B2 | 11/2008 | von Keudell et al. | |
| 7,517,199 | B2 | 4/2009 | Reed et al. | |
| 8,231,310 | B2 | 7/2012 | Sanwald | |
| 8,282,368 | B2 * | 10/2012 | Worrel | F04B 39/108 417/571 |
| 8,342,824 | B2 | 1/2013 | Christian et al. | |
| D707,259 | S | 6/2014 | Timmer | |
| 2007/0122291 | A1 | 5/2007 | Okumura et al. | |
| 2009/0217994 | A1 * | 9/2009 | Chen | B41J 2/17596 137/605 |
| 2010/0172779 | A1 | 7/2010 | Suss et al. | |
| 2012/0164010 | A1 | 6/2012 | Pascual | |
| 2013/0055887 | A1 | 3/2013 | Kroupa et al. | |
| 2016/0036182 | A1 | 2/2016 | Pascual | |
| 2016/0053756 | A1 * | 2/2016 | Han | F16K 15/148 251/332 |

FOREIGN PATENT DOCUMENTS

| | | | |
|---|---|---|---|
| DE | 10117531 | A1 | 10/2002 |
| DE | 102006048454 | | 11/2007 |
| DE | 202006020237 | U1 | 2/2008 |
| DE | 102008035592 | A1 | 2/2010 |
| DE | 102008037672 | A1 | 2/2010 |
| DE | 102015205651 | A1 | 9/2016 |
| EP | 3327287 | A1 | 5/2018 |
| JP | H0630471 | U | 4/1994 |
| WO | 2013032587 | A1 | 3/2013 |

OTHER PUBLICATIONS

International Preliminary Report on Patentability in International Appln. No. PCT/EP2019/077346, dated Apr. 22, 2021, 17 pages (with English translation).

International Search Report and Written Opinion in International Appln. No. PCT/US2015/013685, dated Sep. 11, 2015, 9 pages.

Wilden Pump and Engineering LLC, Catalog image compilation, available on or before Jan. 23, 2017, 6 pages.

Wilden Pump and Engineering LLC, Manual image compilation, available on or before Jan. 23, 2017, 6 pages.

Wilden, Prior Art 2.68" Diaphragm, Mar. 12, 2009, 1 page.

Extended European Search Report in European Appln No. 23214388.3, mailed on Mar. 20, 2024, 17 pages (with English translation).

* cited by examiner

A-A

DIAPHRAGM PUMP

CROSS-REFERENCE TO RELATED APPLICATIONS

This application is a national stage application under 35 U.S.C. § 371 of International Patent Application No. PCT/EP2019/077349 filed on Oct. 9, 2019, the subject matter of which is incorporated by reference herein in its entirety for all purposes.

FIELD OF INVENTION

The invention relates to a diaphragm pump with a pump chamber, the pump chamber being connected to an inlet chamber via an inlet valve and to an outlet chamber via an outlet valve. The invention also relates to a device for conveying fluids with a diaphragm pump.

BACKGROUND

Diaphragm pumps with a pump head essentially connected to a drive are established by DE 101 17 531 A1 and DE 20 2006 020 237 U1. The pump head has several, for example four, pump chambers, each of which is sealed off from a drive system chamber by means of a pump diaphragm. The respective pump diaphragm is connected via an associated pump element to a swash plate located in the drive system chamber. A wobbling motion of the swash plate thereby sets the pump diaphragm into a wobbling axially periodic pumping movement. The swash plate sits on a drive pin of a drive shaft connected to the drive. The drive pin is thereby angled relative to the longitudinal axis of the drive shaft and connected to the swash plate via a ball bearing. In the diaphragm pumps according to DE 101 17 531 A1 and DE 20 2006 020 237 U1, an outlet chamber is positioned centrally, and an inlet chamber is positioned concentric to the outlet chamber around the outlet chamber.

A diaphragm pump with at least one pump chamber is established by EP 3 327 287 A1. The pump chamber is connected to an inlet chamber via an inlet valve and to an outlet chamber via an outlet valve, the inlet valve having an inlet opening that can be closed by an inlet valve body and the outlet valve having an outlet opening that can be closed by an outlet valve body. The outlet opening surrounds the inlet opening, or the inlet opening surrounds the outlet opening.

Diaphragm pumps are used in particular in the fields of chemistry, pharmaceuticals, and biotechnology, in which the conveyed media are sometimes very expensive, so it is desirable that to the extent possible, little to no residual volume of the conveyed medium remains in the diaphragm pump after the pumping process. Furthermore, a complete filling of such diaphragm pumps with the fluid without air inclusions is advantageous for the conveying rate.

The disadvantage of the diaphragm pumps established by DE 101 17 531 A1 and DE 20 2006 020 237 U1, which are fundamentally well proven, is that they have a central inlet chamber which, because of the external outlet chamber positioned essentially concentric to the inlet chamber, a relatively large residual volume of the conveyed medium remains in the inlet chamber after the pumping process has ended. Furthermore, mostly air remains in the upper pump chambers of the pump, which as a rule has a disadvantageous effect on the conveying stability (pulsation) as well as the pumping capacity. The disadvantage of the diaphragm pump established by EP 3 327 287 A1, which is also fundamentally well proven, is that the provision of an outlet opening that surrounds the inlet opening or the provision of an inlet opening that surrounds the outlet opening places relatively high demands on the design of the diaphragm pump, in particular with the design of individual inlet chambers that are connected to an inlet valve.

SUMMARY

The object of the present invention is therefore to improve the established diaphragm pumps with regard to the residual emptying and/or the venting of the pump chambers, the aim being a simple structure and/or a simple design.

This object is achieved by the subject matter of the independent claims. Advantageous embodiments are described in the subclaims and the following description.

The invention is based on the basic idea of choosing the location of two outlet valves in the pump chamber and one inlet valve in the pump chamber more effectively in order to improve the residual emptying and/or venting of the pump chamber and also to make the structure simpler. The invention has recognized for the first time that the provision of two outlet valves, which are provided in addition to the inlet valve, can lead to a simpler structure if the two outlet valves and the inlet valve are arranged in the corners of any triangle. Up to now, it has been assumed that a direct spatial relationship between outlet openings and inlet openings is necessary, in that, for example, the inlet opening should be surrounded by the outlet opening. Among other things, the invention has destroyed the preconception that no offset arrangement of the outlet valves relative to the inlet valve enables an improvement on the diaphragm pump. Instead of an arrangement of the inlet/outlet openings, the invention is primarily based on an essentially special arrangement of an inlet valve and two outlet valves of a pump chamber, by means of which the residual amount of conveyed medium and also the air remaining in the pump chamber after the pumping process has ended can be reduced and complete emptying is also possible. One of the outlet valves can be positioned in the upper area of the pump chamber based on the direction of acceleration due to gravity and the other outlet valve in the lower area of the pump chamber based on the direction of the acceleration due to gravity. The inlet valve is thereby offset from the outlet valves of a respective pump chamber so that an advantageous placement of the outlet valves can be achieved. For example, the inlet valve can be positioned next to, or beside, the lower of the two outlet valves. In addition to the particular possibility of the diaphragm pump automatically emptying and/or venting itself to the extent possible, an improved flow distribution with a simpler structure of the diaphragm pump can be enabled.

According to a first aspect of the invention, the diaphragm pump has at least one pump chamber, the pump chamber being connected to an inlet chamber via an inlet valve and to an outlet chamber via two outlet valves. The inlet valve has an inlet opening that can be closed by an inlet valve body. Each outlet valve has an outlet opening that can be closed by an outlet valve body. Two outlet valves are provided for the pump chamber, and the two outlet valves and the inlet valve form a triangle in a projection onto a projection plane transverse to the longitudinal axis of the pump chamber. The offset arrangement of the inlet valve and the two outlet valves enables optimal positioning for the pump chamber. In particular, an outlet valve can be positioned in the lower area and another outlet valve in the upper area of the pump chamber, independent of the location of the inlet valve in the pump chamber. The inlet valve can be positioned in the lower region of the pump chamber. The inlet valve can be positioned closer to a center axis of the diaphragm pump than the outlet valves. The arrangement of the two outlet valves and the inlet valve enables a simple structure of the diaphragm pump. In arranging the two outlet valves with the inlet valve to form a triangle, it is possible for projections of a straight connecting line of each of the two outlet valves with the inlet valve of the pump chamber on a projection plane transverse to the longitudinal axis, the projection plane having a point in common with the longitudinal axis, to have an angle to each other unequal to 0 degrees.

In the sense of the description, the term "center axis" or "central axis" of the diaphragm pump denotes an axis that extends essentially transverse to the front plate, the valve plate, and/or the end plate (the center axis or central axis can extend essentially parallel to the normal of the front plate, the valve plate, and/or end plate) and can essentially be central to one of the plates. In a preferred embodiment, the center axis or central axis can run centrally through an inlet that is in particular positioned centrally, in particular in a front panel.

In the sense of the description, the term "longitudinal axis" of the pump chamber includes an axis which, in particular, runs transverse to the valve plate (essentially parallel to the normal of the valve plate). The longitudinal axis is thereby positioned essentially central to the pump chamber, in particular essentially central to the pump diaphragm. The longitudinal axis of the pump chamber runs essentially parallel to the central axis or center axis of the diaphragm pump.

In a second aspect of the invention, the diaphragm pump has at least one pump chamber, the pump chamber being connected to an inlet chamber via an inlet valve and to an outlet chamber via two outlet valves. The inlet valve has an inlet opening that can be closed by an inlet valve body, and each outlet valve has an outlet opening that can be closed by an outlet valve body. Two outlet valves are provided for the pump chamber. A projection of straight connecting lines that each connect adjacent outlet valves with one another does not intersect with inlet valves on a projection plane transverse to the longitudinal axis of the pump chamber. It is possible that although two outlet valves are provided per pump chamber, the outlet valves corresponding to an inlet valve are arranged in such a way that an arrangement of the outlet valves corresponding to an inlet valve yields, in addition to the desired residual emptying, the venting of the pump chamber, the conveying stability, and the pumping capacity, a simple structure with regard to the inlet chamber or outlet chamber fluidically connected to the inlet valves and the outlet valves. This can be achieved in that the inlet valves can be combined in a common inlet chamber and/or the outlet valves can be combined in a common outlet chamber.

In a third aspect of the invention, the diaphragm pump has at least two pump chambers, each pump chamber being connected to a respective inlet chamber via a respective inlet valve and to an outlet chamber via two respective outlet valves. Each inlet valve has an inlet opening that can be closed by a respective inlet valve body, and each outlet valve has an outlet opening that can be closed by a respective outlet valve body. The inlet valves are situated in a common inlet chamber. In this way, the design and/or construction can be simplified; in particular, in the case of diaphragm pumps with a modular structure, an attempt can be made to use a plate that has already been used for diaphragm pumps. It can be achieved that an improvement in terms of residual emptying, venting, and/or pulsation is achieved only by changing the arrangement of the outlet and/or inlet valves of the pump chamber, without the plates forming the inlet chamber and/or outlet chamber having to be changed. In addition, the expenditure for sealing the one inlet chamber can be reduced compared to the provision of multiple inlet chambers. In a particularly preferred embodiment, the inlet chamber can be designed essentially in the center.

The aforementioned aspects of the invention can be freely combined with one another and further improvements can result.

The diaphragm pump has a pump chamber, preferably two and particularly preferably three, four, or more pump chambers. This pump chamber, or the plurality of pump chambers, can undergo a volume change by an external force, in particular periodically, particularly preferably cyclically. Particularly preferably, at least one wall of the chamber volume is formed by a diaphragm, which is preferably made of one or more elastomeric materials, for example, plastic, rubber, elastomer, silicone, or an equivalent material, which in particular can also comprise one or more composite materials for increased stability and lifespan. If the wall formed by the diaphragm is designed in such a way that it can completely close off the space provided for the formation of the pump chamber, the pump chamber can be dimensioned with regard to the maximum volume of the pump chamber so that this maximum volume systematically corresponds to exactly the same as the volume of fluid conveyed during a pump stroke. However, (significantly) larger pump chambers are also conceivable, which can, for example, improve the flow behavior, the efficiency of the diaphragm pump, or the production costs.

A valve body in the context of the description can in particular be formed by an elastomeric diaphragm that, as a rule, at least partially releases the valve opening corresponding to the valve body when a suitable pressure differential is present. Metals are also possible examples of materials for the valve body, but in particular also plastic, rubber, elastomer, silicone, or an equivalent material, which in particular can also comprise one or more composite materials or be formed from these. If there is a pressure differential in the opposite direction, the valve body closes the valve opening, and/or a spring element is provided that acts on the valve body and shifts it into the closed position when it is in positions other than the closed position, in which the valve body closes the valve opening. A diaphragm is understood here in particular as a disk that mostly has elastomeric and/or resilient properties, wherein it is also possible for these elastomeric and/or resilient properties to only be present in sections, for example in the edge area. The diaphragm can be flat in sections, but in a preferred embodiment, it is curved in the sections in which it seals off a pump chamber, wherein curved sections can be adapted to the stroke. Furthermore, a valve control can control the opening and closing of the valves or influence an optimization of the pumping process.

The inlet valve and/or the outlet valve is particularly preferably an umbrella valve. An umbrella valve is understood to indicate a valve in which the valve body is formed by an umbrella-shaped sealing disk.

In the context of the description, the naming of a number comprises the provision of exactly the number of elements designated by the number, although additional identical or similar elements are not excluded. If it is described in the description, for example, that a pump chamber has two outlet valves, the pump chamber can have exactly two, but also three, four, or more outlet valves. The same applies to the inlet valve. A pump chamber can have exactly one but also two, three, four, or more inlet valves. It is possible for the pump chambers to have a different number of inlet and/or outlet valves.

An inlet chamber in the context of the description functions to keep ready the fluid to be pumped. The inlet opening can be formed directly in a wall of the inlet chamber. This enables a compact structure of the diaphragm pump, in particular if, in a further preferred embodiment, the inlet opening opens directly into the pump chamber. It is possible for an inlet channel that connects the inlet chamber to the pump chamber to be provided between the inlet chamber and the pump chamber. This creates the possibility of more freely positioning the inlet chamber within the diaphragm pump relative to the pump chamber. In a particularly preferred embodiment, the inlet chamber is connected to the pump chamber directly via the inlet opening without the interposition of an inlet channel, so the additional configuration of an inlet channel can be omitted.

An outlet chamber in the context of the description is used to collect and combine the pumped fluid, in particular for transfer to a central outlet of the diaphragm pump, in particular in the case of several pump chambers and/or outlet valves. The outlet opening can be formed directly in a wall of the outlet chamber. This enables a compact structure of the diaphragm pump, in particular if, in a further preferred embodiment, the outlet opening opens directly into the pump chamber. It is possible for an outlet channel that connects the outlet chamber to the pump chamber to be provided between the outlet chamber and the pump chamber. This creates the possibility of more freely positioning the outlet chamber within the diaphragm pump relative to the pump chamber. In a particularly preferred embodiment, the outlet chamber is connected directly to the pump chamber via the outlet opening without the interposition of an outlet channel, which can simplify the construction of the diaphragm pump.

In a preferred embodiment, one outlet valve is positioned in an edge area of the pump chamber, and one outlet valve is positioned in the opposite edge area of the pump chamber. In this way, the outlet valves can be effectively positioned in order to achieve improved residual emptying of the fluid and ventilation. One of the edge areas can be an "upper area" of the pump chamber, and the other edge area can be a "lower area" of the pump chamber. In the context of the description, the terms "upper area" and "lower area" denote two areas of the pump chamber that are present in opposite edge areas of the pump chamber. The term "upper area" denotes the placement of the outlet valve functionally in such a way that at least one outlet opening is provided that is positioned as close as possible to the upper edge of the pump chamber. The direction indication "up" or "upper" is based on the direction of acceleration due to gravity when the diaphragm pump is installed and in the operating position. The direction indication "upper" area describes an edge area of the pump chamber that is farther from the direction of acceleration due to gravity compared to the "lower area." The arrangement of the outlet valves in the upper or lower area comprises a positioning such that one or more outlet openings dedicated to the outlet valve are positioned in the upper or lower edge area of the pump chamber.

In a preferred embodiment, the inlet valve is positioned closer to the central axis of the diaphragm pump than the two outlet valves. As a result, the inlet chamber can be positioned centrally and be surrounded by the outlet chamber, whereby it can be achieved that the outlet chamber can be positioned below the inlet chamber based on the direction of acceleration due to gravity, whereby residual emptying of the entire diaphragm pump can be further improved.

In a preferred embodiment, two outlet valves offset from one another with respect to a vertical are provided for the pump chamber. As a result, variability in the arrangement of the outlet valve and inlet valve can be achieved, which in addition to having a beneficial effect on residual emptying, venting, and conveying stability, also has an effect on the pumping capacity, yet also leads to a simpler design of the diaphragm pump. In the context of the invention, a vertical describes a line that runs transverse to the central axis of the diaphragm pump or transverse to the longitudinal axis of the pump chamber; in particular, the vertical can run parallel to the axis of acceleration due to gravity, the diaphragm pump being viewed in the installed and operable state.

In a preferred embodiment, the inlet valve of the pump chamber is positioned eccentrically in the cross section of the pump chamber. This makes it possible to offset the inlet valve, which can allow for as free a choice as possible in the arrangement of the two outlet valves. Essentially, the inlet valve can be moved into an area of the pump chamber such that the outlet valves can be better positioned while also improving the connection of the pump chamber to the inlet chamber and the outlet chamber via the outlet valves and the inlet valve. In the sense of the description, the term "eccentric" denotes a position specification that essentially corresponds to essentially the center point of the cross section and/or the center of mass of the cross section, wherein a view along the longitudinal axis of the diaphragm pump exists, insofar as it is described that the inlet valve does not lie on an axis through the center point of the cross section or on an axis through the center of mass of the cross section.

In a preferred embodiment, the outlet valves are arranged in a circle or an arc. The outlet valves can be arranged essentially in a circle or an arc on a valve plate, which simplifies the manufacture of the diaphragm pump. In a particularly preferred embodiment, the outlet valves are arranged in a circle or in an arc around a central axis of the diaphragm pump. The circular or arc-shaped arrangement of the outlet valves can lead to a design of an outlet chamber that is less complex. As a result of a circular or arc-shaped configuration, the outlet chamber can have a rotational invariance.

In a preferred embodiment, the diaphragm pump has more than one pump chamber, the arrangement of the inlet valve and the two outlet valves of the pump chambers essentially having a rotational invariance with respect to an angle of less than 360° around the central axis of the diaphragm pump. If several pump chambers are used, a rotational invariance can be created which, in addition to a simple structure or a simple construction, enables simple handling or simple assembly of the diaphragm pump. It can be designed, for example, such that a rotational invariance of 360°/number of pump chambers can be achieved.

In a preferred embodiment, an outlet chamber configured in an annular shape is provided. This makes it possible to construct a simply constructed diaphragm pump; in particular, the outlet chamber can surround the inlet chamber, and the sealing of the outlet chamber can be limited to only one chamber, if possible. In particular with two or more pump chambers, a common outlet chamber and a common inlet chamber can be provided, the outlet chamber surrounding the inlet chamber and no area of the outlet chamber coming between two inlet chambers. The shape of the outlet chamber and/or the inlet chamber can be a simple shape.

In a preferred embodiment, the cross section of the pump chamber has at least one straight section on a side wall. This makes it possible to enlarge the pump chamber compared to a completely curved side wall. A completely curved side wall in the upper or lower area provides direct position arrangements for the outlet valves in that one inlet valve is positioned at the highest point and the other outlet valve at the lowest point of the pump chamber; this is where the air is entrapped or the fluid flows together, although venting or residual emptying can also succeed in straight sections. Despite the imposing shape of a completely curved side wall, it was recognized that the offset arrangement can also increase the size of the pump chamber by providing straight sections of the side wall, in particular in the upper and/or lower area.

In a preferred embodiment, several pump chambers are provided, and the pump chambers are arranged in a grid of columns and rows. The pump chambers can also thereby be designed in different planes. The grid arrangement of the pump chambers essentially above and below one another makes it possible to create an arrangement in which the inlet valve can be offset from a central area in order to be able to position the two outlet valves effectively.

The invention also establishes a device for conveying fluids with a diaphragm pump described in the description and/or the claims, wherein a pump head with a drive system chamber and a drive system are provided, and the pump chamber is sealed off from the drive system chamber by means of a pump diaphragm. If two or more pump chambers are provided, the pump chambers can each be sealed off from the drive system chamber by means of a pump diaphragm. In a preferred embodiment, the pump diaphragm can be set in a periodic axial pumping movement via a designated pump element.

In the context of the present description, the term "outlet opening" not only describes a single opening but is also used to represent a sum of individual openings that are separate from one another. According to a preferred embodiment, the outlet opening is segmented into multiple outlet opening sections, which are spaced apart from one another in relation to the projection plane transverse to the longitudinal axis of the pump chamber. The outlet opening sections of an outlet valve can preferably be circular or arc-shaped. The association of the outlet opening sections with an outlet valve is achieved in a preferred embodiment in that the outlet opening sections are closed by a common valve body. The outlet opening or the outlet opening sections can extend in a direction such that the extension of the outlet opening, or the area in which the outlet opening sections of an outlet valve are, essentially corresponds to ⅕ to ⅓ of the width and/or height of the pump chamber. This enables a high pump throughput to be achieved.

In the context of the description, the term "inlet opening" does not just denote a single opening, but rather the inlet opening can be formed by inlet opening sections that are separate from one another. According to a preferred embodiment, the inlet opening is segmented into multiple inlet opening sections, which are spaced apart from one another in relation to the projection plane transverse to the longitudinal axis of the pump chamber. The inlet opening sections can preferably be arranged in a circle or arc in a projection plane transverse to the longitudinal axis of the pump chamber. The association of the inlet opening sections with an inlet valve is achieved in a preferred embodiment in that the inlet opening sections are closed by a common valve body.

According to a preferred embodiment, the inlet chamber has at its lower end in the vertical direction a wall designed in such a way that the wall meets essentially flush with the lower part of the inlet opening of at least one inlet valve. In particular, one or more inlet valves at the lowest point merge with their respective lower areas of their respective inlet openings into the wall of the inlet chamber in such a way that the inlet chamber can be completely emptied via the inlet valves and the remaining fluid is conveyed from the inlet chamber to the outlet chamber during the pumping process.

According to a preferred embodiment, the outlet chamber has at its lower region in the vertical direction a wall designed in such a way that the wall meets essentially flush with the lower part of the outlet opening of at least one outlet valve. In particular, one or more outlet valves at the lowest point merge with their respective lower areas of their respective outlet openings into the wall of the outlet chamber in such a way that the outlet chamber can be completely emptied via the outlet valves and the remaining fluid is conveyed from the outlet chamber out of the diaphragm pump during the pumping process.

In a preferred embodiment, several, in particular all, outlet valves of the diaphragm pump are designed similarly and particularly preferably have the same outlet opening shape and/or the same valve body shape. In a preferred embodiment, several, in particular all, inlet valves of the diaphragm pump are designed similarly to one another and particularly preferably have the same inlet opening shape and/or the same valve body shape.

In a preferred embodiment, an inlet valve plate is provided, in or on which the inlet valves are arranged spatially separated. In a particularly preferred embodiment, the diaphragm pump has four pump chambers. In a preferred embodiment, the inlet valve plate has four spatially separated inlet valves. In a particularly preferred embodiment, the inlet valve plate has four spatially separated inlet valves, which are arranged annularly.

In a preferred embodiment, an outlet valve plate is provided, in or on which the outlet valves are arranged spatially separated. In a preferred embodiment, the diaphragm pump has four pump chambers. In a preferred embodiment, the outlet valve plate has eight spatially separated outlet valves. In a particularly preferred embodiment, the outlet valve plate has eight spatially separated outlet valves, which are arranged annularly.

In a particularly preferred embodiment, a valve plate is provided, in or on which both the inlet valves and the outlet valves are implemented.

According to a preferred embodiment, a front plate, also to be referred to as a pump housing, and a valve plate are provided. The valve plate can be situated between the front plate on one side and a diaphragm carrier part bearing the pump diaphragm, for example a diaphragm housing cover, on the other side. The inlet chamber or chambers can be formed at least partially in the front plate. The inlet chamber or chambers is/are formed by the contact between the front plate and the valve plate in that recesses formed in the front plate are covered on the rear side by the valve plate. The outlet chamber can be at least partially formed in the front plate. The outlet chamber or chambers is/are formed by the contact between the front plate and the valve plate in that recesses formed in the front plate are covered on the rear side by the valve plate. The inlet valve or valves and the outlet valves can be located on the valve plate. The pump chamber or chambers can be formed at least partially in the valve plate. For simple and cost-effective manufacture, the valve plate can be designed essentially flat. An edge profile, in particular to interact with that of a corresponding profile on the front panel, can be provided.

BRIEF DESCRIPTION OF DRAWINGS

The invention is explained in more detail below with reference to drawings showing two example embodiments of the invention. Shown therein.

DETAILED DESCRIPTION

Figure 1:
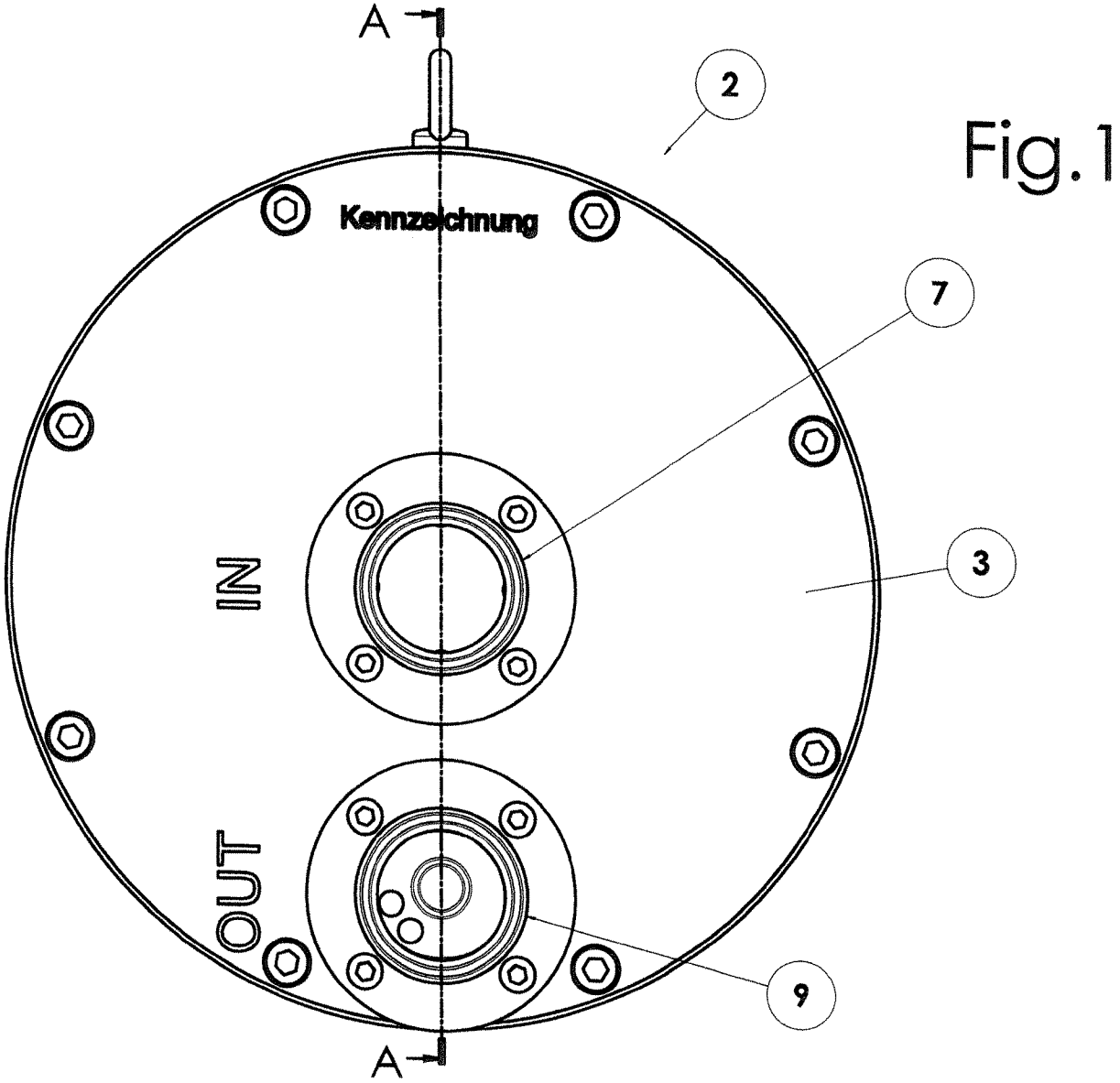
FIG. 1 a front view of a pump head of a diaphragm pump according to the invention (without drive system)

FIG. 1 shows the pump head 2 of a diaphragm pump 1. The diaphragm pump 1 forms part of a device for conveying a fluid.

Figure 2:
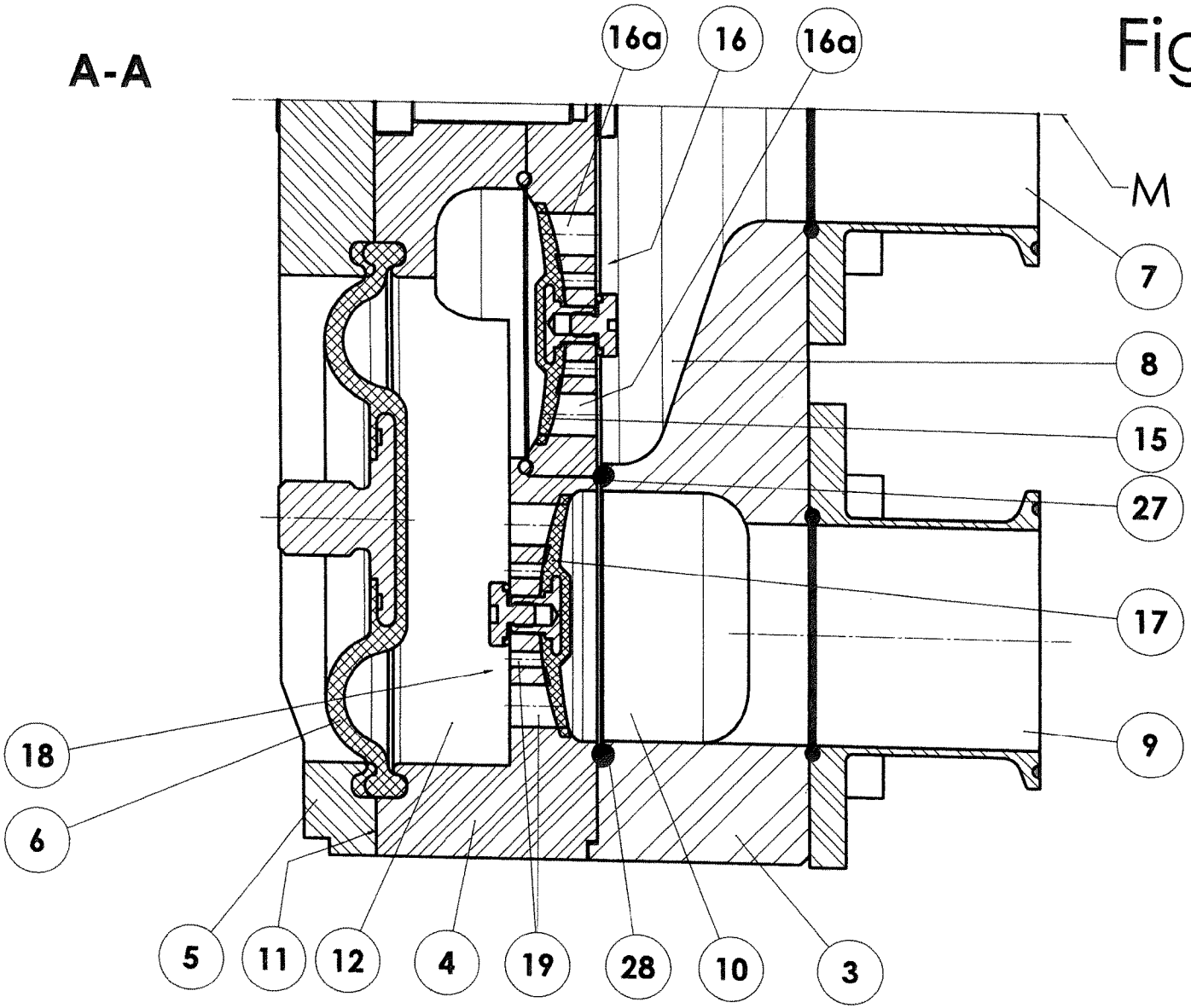
FIG. 2 a sectional view along the cutting plane line A-A of FIG. 1.

In FIG. 2, it is to be gathered that the pump head 2 has a front plate 3, which can also be referred to as a chamber housing, a valve plate 4, and an end plate 5 with pump diaphragms 6, the end plate 5 also able to be referred to as a diaphragm carrier, which are connected via pump elements to a swash plate not shown in FIG. 2.

An inlet 7, which is central in this embodiment and opens into a central inlet chamber 8, is provided on the front plate 3. An outlet 9 is provided on the front plate 3, which is connected to an outlet chamber 10 which is annular in this embodiment and which surrounds the inlet chamber 8.

The valve plate 4 is situated between the front plate 3 and the end plate 5. The valve plate 4 has four pump chambers 12 on its rear side 11 facing the end plate 5. The pump chambers 12, which are open towards the end plate 5, are each closed or restricted by a pump diaphragm 6. The pump diaphragms 6 are situated between the end plate 5 and the valve plate 4. A bead 13 of the pump diaphragm 6, which is annular in this embodiment, is situated in a groove 14 of the valve plate 4 circumscribing the pump chamber 12.

The valve plate 4 caps the inlet chamber 8 of the front plate 3 and the outlet chamber 10 of the front plate 3. The valve plate 4 has four inlet valves 15, which are designed as umbrella valves. The inlet chamber 8 is connected to the pump chamber 12 via an inlet opening 16 dedicated to the inlet valve 15. The inlet opening 16 is partitioned and has multiple inlet opening sections 16*a*.

The valve plate 4 seals the annular outlet chamber 10 of the front plate 3. The valve plate 4 is essentially flat and has eight outlet valves 17, which correspond to the outlet chamber 10 and which are also designed as umbrella valves. The outlet opening 18 of the outlet valve 17 is formed by outlet opening sections 19.

An inlet valve 15 is provided for each pump chamber 12. Each pump chamber 12 has two outlet valves 17.

Figure 3:
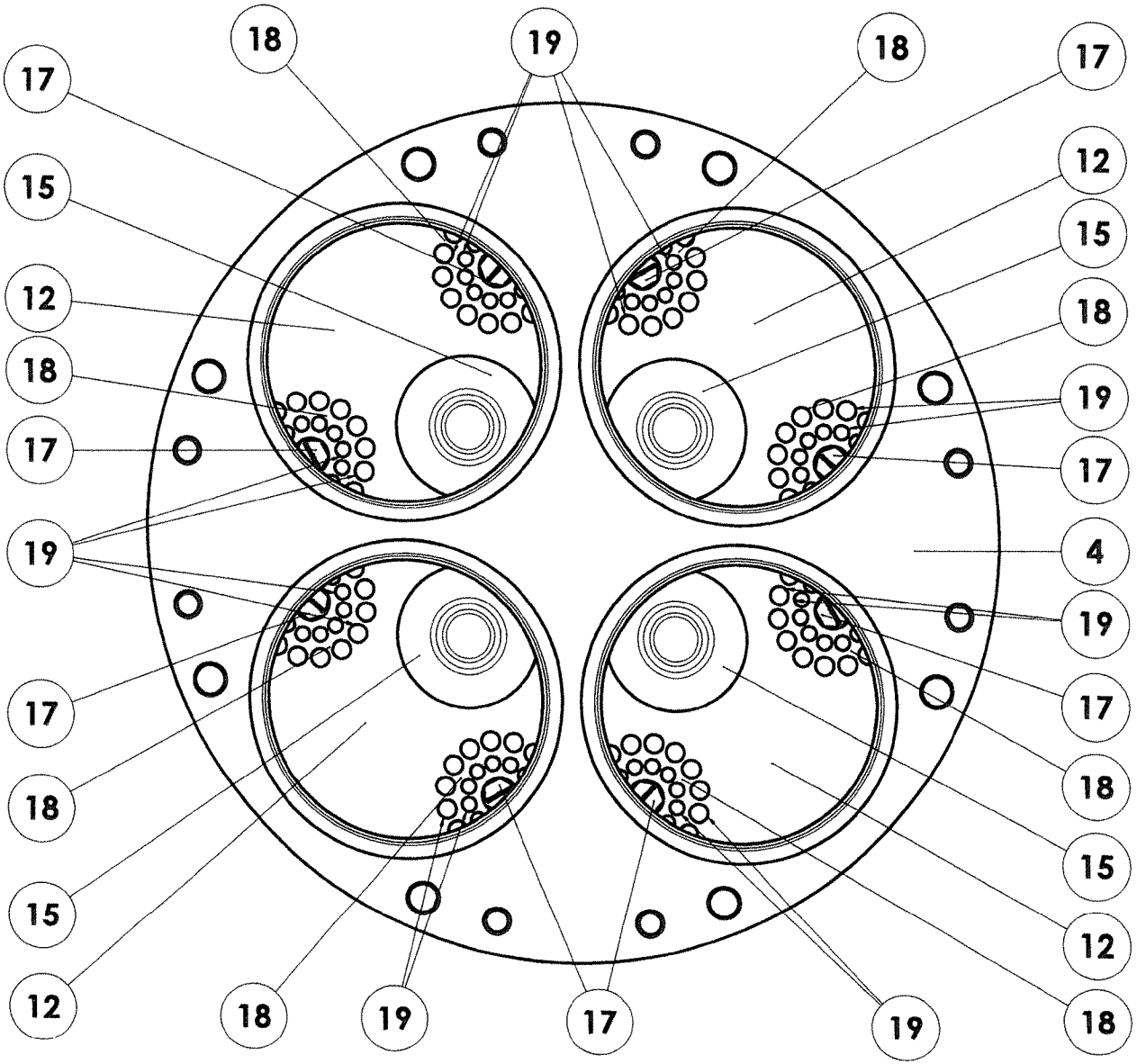
FIG. 3 a rear view of a valve plate of the diaphragm pump.

The two outlet valves 17 and the inlet valve 15 form a triangle in a projection onto a projection plane transverse to the longitudinal axis L of the pump chamber 12, which runs essentially parallel to a central axis M of the diaphragm pump 1, as shown in FIG. 3.

FIG. 3 also shows that adjacent outlet valves 17 on the valve plate 4 can be connected with straight connecting lines, and a projection of these on a projection plane transverse to the longitudinal axis L of the pump chamber 12 is free of intersection with the inlet valves 15.

The two outlet valves 17 of a pump chamber are positioned in opposite edge regions of the pump chamber 12. One of the two outlet valves 17 is positioned in an upper region of the pump chamber 12, while the other of the two outlet valves 17 is positioned in a lower region of the pump chamber 12. Venting of the pump chamber 12 is possible by means of the upper of the two outlet valves 17. Residual emptying is possible by means of the lower of the two outlet valves 17. The inlet valve 15 of a pump chamber 12 is positioned laterally offset to one of the two outlet valves 17. The inlet valves 15 are thereby positioned closer to the central axis M of the diaphragm pump 1 than the outlet valves 17 of the pump chambers 12.

The two outlet valves 17 of a pump chamber 12 are arranged offset from one another with respect to a vertical that runs essentially along the section A-A or parallel to it. The inlet valve 15 is eccentric with respect to the cross section of the pump chamber 12.

The outlet valves 17 of the diaphragm pump 1 are arranged in a circle around the central axis M of the diaphragm pump 1.

With regard to the valve plate 4, there is a rotational invariance of 90° around the central axis M of the diaphragm pump 1. In FIG. 3, it is likewise to be gathered that the four pump chambers 12 are arranged in a grid of columns and rows, the pump chambers 12 being arranged one above the other and next to one another.

Figure 4:
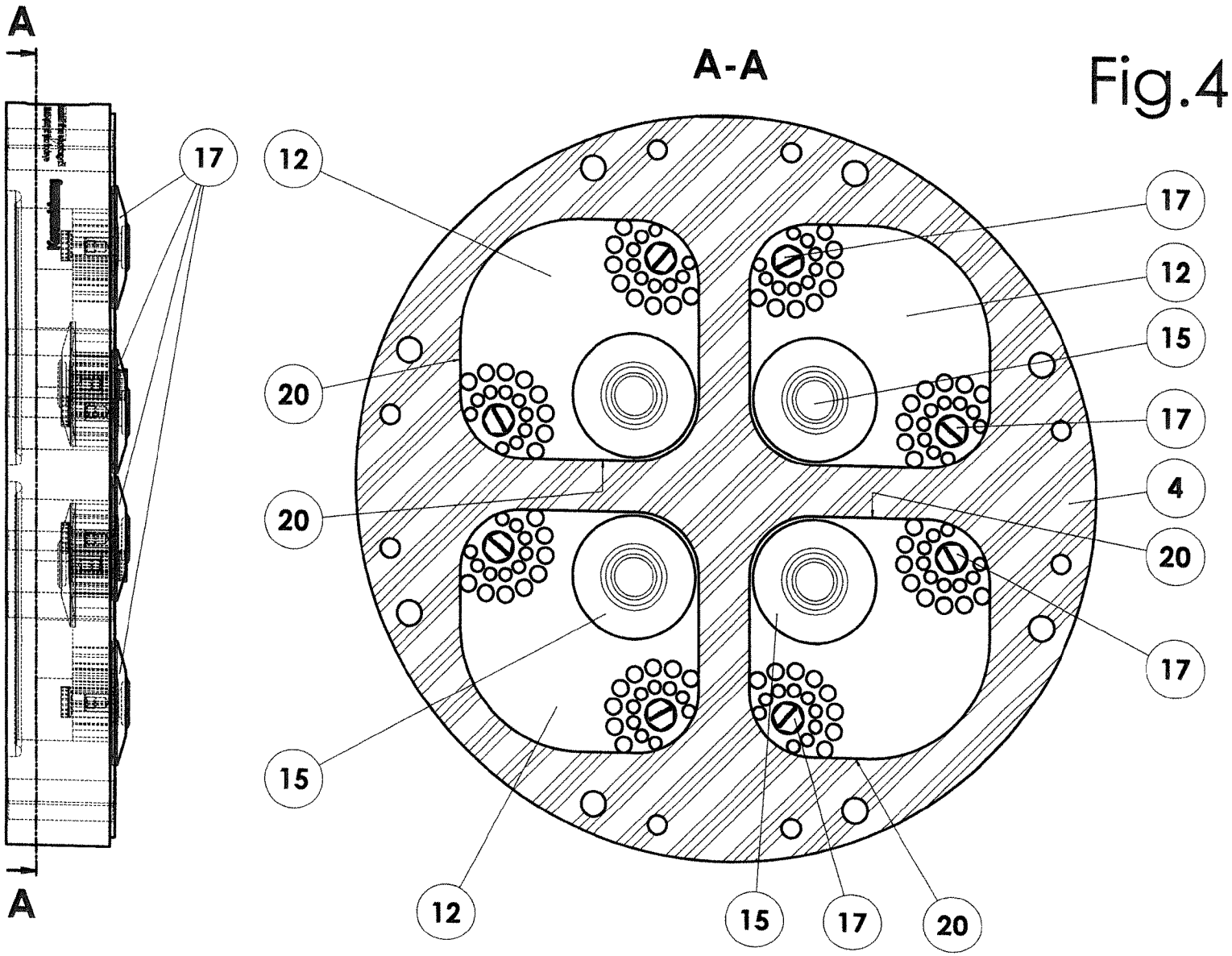
FIG. 4 a rear view of a valve plate cut along the cutting plane line A-A in FIG. 4.

FIG. 4 is to be taken as a differently configured cross section of the pump chambers 12 in comparison to FIG. 3 for a further example embodiment of the diaphragm pump 1. Apart from the cross-section of the pump chambers 12, the embodiments are otherwise the same and correspond to one another, so no repetition is necessary here. The cross section of the pump chamber 12 depicted in FIG. 4 has straight sections 20 on the side wall of the pump chamber 12, which have an intersection with the vertical and/or horizontal of a cross section of the pump chamber 12.

Figure 5:
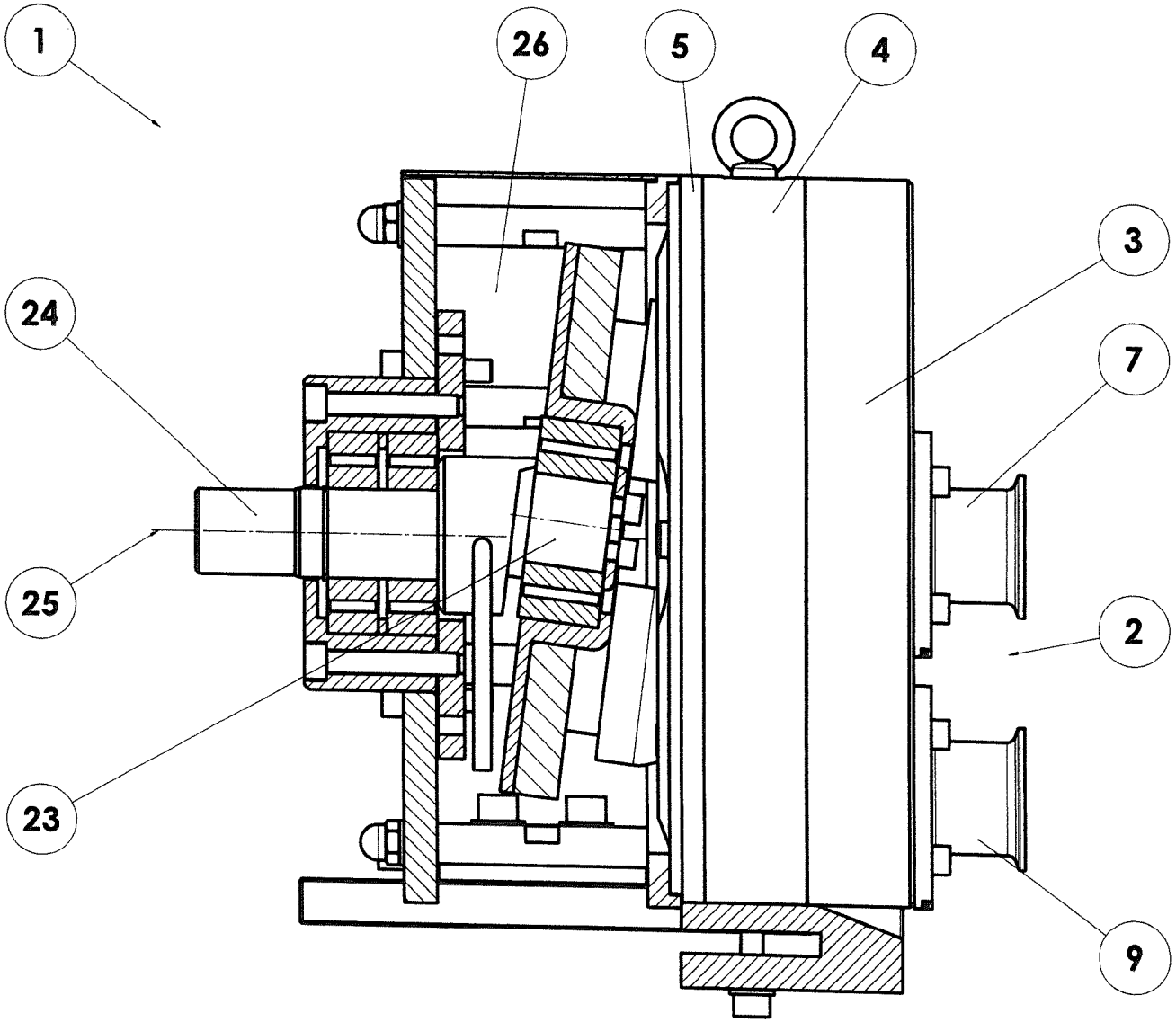
FIG. 5 a device for conveying fluid.

The swash plate 21 shown in FIG. 5 is connected to a pin 23 of a drive shaft 24 via a ball bearing 22. The pin 23 is angled with respect to the longitudinal axis 25 of the drive shaft 24 in order to generate a wobbling motion of the swash plate 21. The connection between the drive axle and the swash plate 21 is located in the area of the drive system chamber 26, which is in front of the end plate 5. The inlet chamber 8 is sealed off from the outlet chamber 10 by a seal 27, which in the example is designed as a cord ring seal. The outer boundary of the outlet chamber 10 is sealed by a seal 28, which in the example is also designed as a cord ring seal.

By rotating the drive shaft 24 about its longitudinal axis 25, the swash plate 21 is set in a circumferential wobbling motion without rotating with the drive shaft 24 due to the angle of the pin 23. As a result of the wobbling motion of the swash plate 21, the pump diaphragms 6 are set in a periodic axial pumping movement, by means of which, alternating in the pump chambers 12, negative pressure is generated in the suction cycle by the movement in the direction of the drive system chamber 26 and positive pressure in the discharge cycle by a movement in the direction of the front plate 3.

Due to the downstream location of the umbrella valve of the inlet valve 15, the inlet valve 15 opens and the corresponding outlet valve 17 closes automatically when there is negative pressure in the associated pump chamber 12. When there is positive pressure in the pump chamber 12, the associated inlet valve 15 closes, and the corresponding outlet valve 17 opens automatically. As a result, the pumped medium is conveyed out of the pump chamber 12 through the outlet chamber 10 to the outlet 9.

The invention claimed is:

1. A diaphragm pump comprising:

an inlet chamber;

an outlet chamber; and a pump chamber comprising:

an inlet valve that provides a fluid pathway to the inlet chamber, the inlet valve having an inlet opening that can be closed by an inlet valve body; and a first outlet valve and a second outlet valve that each provide a fluid pathway to the outlet chamber and each outlet valve having an outlet opening that can be closed by a respective outlet valve body, wherein the first outlet valve, the second outlet valve, and the inlet valve form an obtuse triangle when projected onto a projection plane transverse to a longitudinal axis of the pump chamber, and wherein one of the first outlet valve or the second outlet valve is positioned vertically lower than the inlet valve within the projection plane to, thereby, permit emptying of residual fluid from the pump chamber.

2. The diaphragm pump of claim 1, further comprising a second pump chamber that comprises:

a second inlet valve that provides a respective fluid pathway to the inlet chamber; and a third outlet valve and a fourth outlet valve that each provide a respective fluid pathway to the outlet chamber, wherein the third outlet valve, the fourth outlet valve, and the second inlet valve form an obtuse triangle when projected onto a projection plane transverse to a longitudinal axis of the second pump chamber.

3. The diaphragm pump of claim 2, wherein a projection of straight connecting lines connect adjacent outlet valves configured to be free of intersection with inlet valves on the projection plane transverse to the longitudinal axis of the pump chamber.

4. The diaphragm pump of claim 1, wherein the first outlet valve is positioned in an edge region of the pump chamber, and the second outlet valve is positioned in an opposite edge region of the pump chamber.

5. The diaphragm pump of claim 1, wherein the inlet valve is positioned closer to a central axis of the diaphragm pump than the first and second outlet valves.

6. The diaphragm pump of claim 1, wherein the first outlet valve is offset vertically from the second outlet valve within the projection plane.

7. The diaphragm pump of claim 1, wherein the inlet chamber and the outlet chamber are at least partially formed in a front plate.

8. The diaphragm pump of claim 1, wherein the inlet valve is positioned eccentrically in the cross section of the pump chamber.

9. The diaphragm pump of claim 1, wherein the first and second outlet valves are arranged in a circle or an arc.

10. The diaphragm pump of claim 1, wherein pump chamber is one of a plurality of pump chambers, and wherein an arrangement of each respective inlet valve and each of the respective first and second outlet valves of the respective pump chambers essentially has rotational invariance with respect to an angle of less than 360° about the central axis.

11. The diaphragm pump of claim 1, wherein the outlet chamber is configured in an annular shape.

12. The diaphragm pump of claim 1, wherein the cross section of the pump chamber has at least one essentially straight section on a side wall.

13. The diaphragm pump of claim 1, wherein the pump chamber is one of a plurality of pump chambers which are arranged in a grid of columns and rows.

14. A device for pumping fluids with a diaphragm pump of claim 1, further comprising a pump head with a drive system chamber and a drive system, the pump chamber being sealed from the drive system chamber by means of a pump diaphragm.

15. The diaphragm pump of claim 1, wherein the an inlet opening comprises a plurality of outlet openings that can be closed by the inlet valve body, and wherein the respective outlet opening of each of the first and the second outlet valve comprises a plurality of outlet openings that can be closed by the respective outlet valve body.

16. A diaphragm pump comprising:

an inlet chamber;

an outlet chamber; and a pump chamber comprising:

an inlet valve that provides a fluid pathway to the inlet chamber, the inlet valve having an inlet opening that can be closed by an inlet valve body; and a first outlet valve and a second outlet valve that each provide a fluid pathway to the outlet chamber, and each outlet valve having an outlet opening that can be closed by a respective outlet valve body, wherein the first outlet valve is offset in a clockwise direction by a first angle from a radial projection extending from a central axis of the pump through a center of the inlet valve, wherein the second outlet valve is offset in a counterclockwise direction by a second angle from the radial projection, and wherein one of the first outlet valve or the second outlet valve is positioned vertically lower than the inlet valve within the projection plane to, thereby, permit emptying of residual fluid from the pump chamber.

17. The diaphragm pump of claim 16, wherein the an inlet opening comprises a plurality of outlet openings that can be closed by the inlet valve body, and wherein the respective outlet opening of each of the first and the second outlet valve comprises a plurality of outlet openings that can be closed by the respective outlet valve body.

18. The diaphragm pump of claim 16, wherein the first outlet valve, the second outlet valve, and the inlet valve form an obtuse triangle when projected onto a projection plane transverse to the central axis of the pump.

19. The diaphragm pump of claim 16, further comprising a second pump chamber that comprises:

a second inlet valve that provides a respective fluid pathway to the inlet chamber; and a third outlet valve and a fourth outlet valve that each provide a respective fluid pathway to the outlet chamber, wherein the third outlet valve is offset in a clockwise direction by a third angle from a second radial projection extending from the central axis of the pump through a center of the second inlet valve, and wherein the fourth outlet valve is offset in a counterclockwise direction by a fourth angle from the second radial projection.

20. The diaphragm pump of claim 16, wherein the first outlet valve is positioned in an edge region of the pump chamber, and the second outlet valve is positioned in an opposite edge region of the pump chamber, wherein the inlet chamber and the outlet chamber are at least partially formed in a front plate, wherein the inlet valve is positioned eccentrically in the cross section of the pump chamber, wherein the first and second outlet valves are arranged in an arc, and wherein the outlet chamber is configured in an annular shape surrounding the inlet chamber.

21. A diaphragm pump comprising:

a front plate defining a central inlet chamber and an annular outlet chamber surrounding the inlet chamber; and a valve plate defining a plurality of pump chambers, wherein the diaphragm pump is configured such that during normal operation at least two pump chambers are in vertical alignment with each other, and wherein each pump chamber comprises:

a longitudinal axis that is oriented horizontally during normal operation;

an inlet valve that provides a fluid pathway to the inlet chamber;

a first outlet valve that provides a first fluid pathway from the pump chamber to the outlet chamber, wherein the first outlet valve is positioned vertically above the inlet valve within a projection plane transverse to the longitudinal axis of the pump chamber to, thereby, permit venting of the pump chamber; and a second outlet valve that provides a second fluid pathway to the outlet chamber, wherein the second outlet valve is positioned vertically below the inlet valve within the projection plane to, thereby, permit emptying of residual fluid from the pump chamber.

* * * * *